US008356816B2

(12) United States Patent
DiCarlo

(10) Patent No.: US 8,356,816 B2
(45) **Date of Patent: *Jan. 22, 2013**

(54) MULTI-HAND POKER WITH CARD TRANSFORMATIONS

(75) Inventor: Fernando DiCarlo, Woodbridge (CA)

(73) Assignee: American Gaming Systems Toronto, Ltd. (CA)

( * ) Notice: Subject to any disclaimer, the term of this patent is extended or adjusted under 35 U.S.C. 154(b) by 70 days.

This patent is subject to a terminal disclaimer.

(21) Appl. No.: 12/684,971

(22) Filed: Jan. 11, 2010

(65) Prior Publication Data

US 2010/0178970 A1 Jul. 15, 2010

Related U.S. Application Data

(63) Continuation of application No. 11/074,588, filed on Mar. 8, 2005, now Pat. No. 7,669,855.

(51) Int. Cl.
*A63F 1/00* (2006.01)

(52) U.S. Cl. ..... 273/292

(58) Field of Classification Search ..... None
See application file for complete search history.

(56) References Cited

U.S. PATENT DOCUMENTS

| | | | | |
|---|---|---|---|---|
| 5,823,873 | A * | 10/1998 | Moody | 463/13 |
| 6,098,985 | A * | 8/2000 | Moody | 273/292 |
| 6,176,781 | B1 * | 1/2001 | Walker et al. | 463/13 |
| 7,000,921 | B2 * | 2/2006 | Schultz | 273/292 |
| 7,137,628 | B2 * | 11/2006 | Moody | 273/292 |
| 2004/0229672 | A1 * | 11/2004 | Aoki et al. | 463/13 |

* cited by examiner

*Primary Examiner* — Masud Ahmed
(74) *Attorney, Agent, or Firm* — Weide & Miller, Ltd.

(57) ABSTRACT

A method of implementing a wagering game. A first hand of cards is dealt on a first row. Cards can be held or discarded by a player. Cards that are held are transformed into a card with a same face value but a different suit and copied into an additional row. Cards not held are replaced in the first row and the additional row.

18 Claims, 5 Drawing Sheets

MULTI-HAND POKER WITH CARD TRANSFORMATIONS

This application is a continuation application of U.S. application Ser. No. 11/074,588, filed in the USPTO on Mar. 8, 2005 now U.S. Pat. No. 7,669,855, now allowed, which is incorporated by reference herein in its entirety for all purposes.

BACKGROUND OF THE INVENTION

1. Field of the Invention

The present invention is directed to a method, device, and computer readable storage medium for implementing a poker-type game.

2. Description of the Related Art

Video poker games are a popular form of wagering in a casino. Casinos are always introducing new variations on their floor in order to entice players with new variations.

What is needed is a new variation of wagering game that some players may find preferable.

SUMMARY OF THE INVENTION

It is an aspect of the present invention to provide players a wagering game which can be exciting for players as well as generating increased revenue for a casino over a standard game.

The above aspects can be obtained by a method that includes: (a) dealing a first row of cards; (b) receiving an indication of hold cards and discard cards in the first row from a player; (c) transforming each of the hold cards into a transformed card and displaying the transformed card in an additional row; (d) receiving an indication from the player to draw; (e) replacing the discard cards in the first row to form a first hand; and (f) dealing additional cards in the additional row to form an additional hand.

The above aspects can also be obtained by a method that includes (a) dealing a first row of cards; (b) allowing a player to select a selected card; (c) determining a transformed card by altering a suit of the selected card; and (d) displaying the transformed card in a second row.

The above aspects can also be obtained by a computer readable storage storing a method of implementing a wagering game, the storage controlling a computer to perform (a) dealing a first row of cards; (b) receiving an indication of hold cards and discard cards in the first row from a player; (c) transforming each of the hold cards into a transformed card and displaying the transformed card in an additional row; (d) receiving an indication from the player to draw; (e) replacing the discard cards in the first row to form a first hand; and (f) dealing additional cards in the additional row to form an additional hand.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which.

DESCRIPTION OF THE PREFERRED EMBODIMENTS

Figure 1:
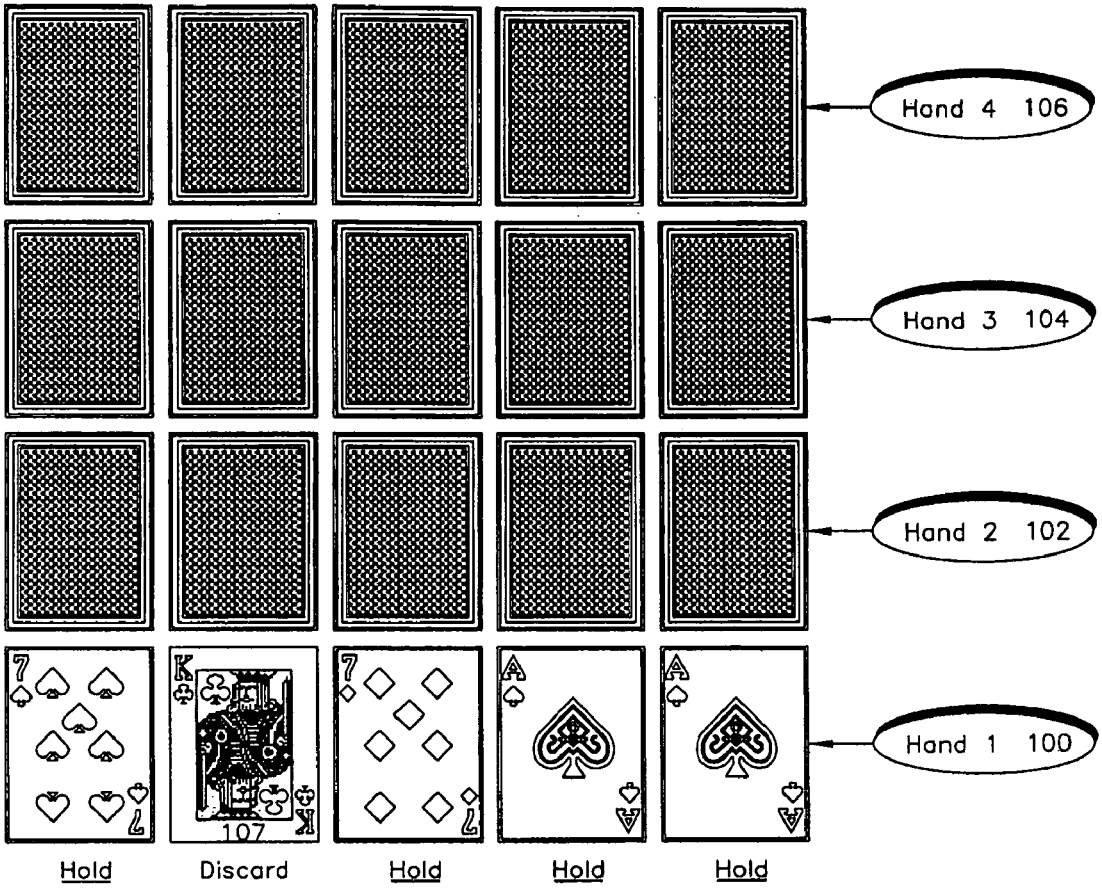
FIG. 1 is an exemplary output of a first stage, according to an embodiment.

Reference will now be made in detail to the presently preferred embodiments of the invention, examples of which are illustrated in the accompanying drawings, wherein like reference numerals refer to like elements throughout.

The present invention relates to a multi-line video poker game in which cards on the bottom row can be transformed and placed in other respective positions. The game can be played on an electronic gaming device such as a video poker machine, a personal computer, on an Internet gambling site, or with a physical deck of cards.

FIG. 1 is an exemplary output of a first stage, according to an embodiment.

Five cards are dealt into hand one 100 (although any number of cards can be used). A player can indicate which cards to hold or discard using an input device such as a touch screen, buttons, etc. In this example, all cards are held but the second card 107. Hand two 102, hand three 104, and hand four 106 are face down cards at this point.

After the first stage as illustrated in FIG. 1, the method can then proceed to a second stage which transforms the held cards.

Figure 2:
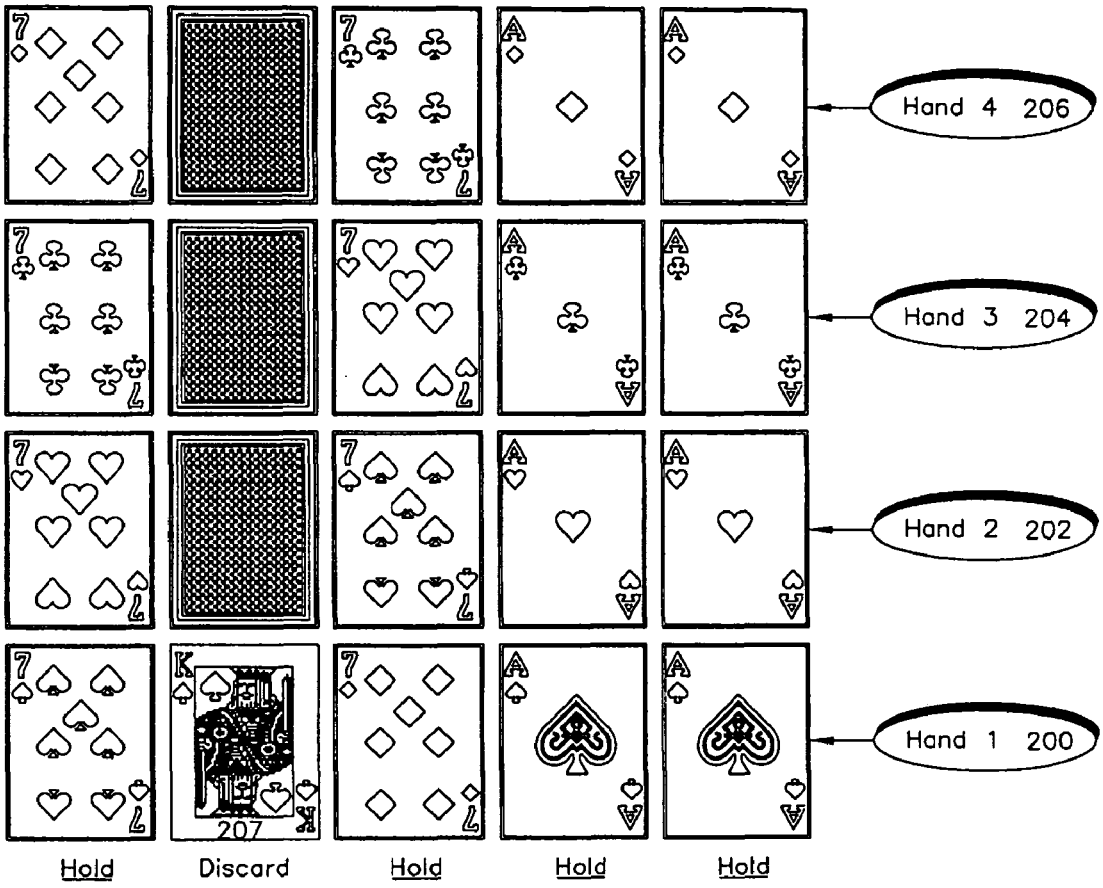
FIG. 2 is an exemplary output of a second stage, according to an embodiment.

FIG. 2 is an exemplary output of a second stage, according to an embodiment.

Cards that are selected to be held are transformed into transformed cards and placed in respective locations. A held card can be transformed by using the held card's same face value but mapping the held card's suit to a different suit. Other transformations can be used as well.

For example, the first held card in hand one 200 is a 7 spades. A transformed card is a 7 hearts, which is the same face value but a mapped suit. Thus, the 7 hearts appears in a same position as the held card (7 spades) but in hand two 202. The held card (7 spades) is also transformed into a 7 clubs for hand three 204, and a 7 diamonds for hand four 206.

One way the mapping can be performed electronically is by using an identification number (1-52) representing each card in a deck. Numbers 1-13 represent A, 2, 3, . . . K of clubs, 14-26 represent A, 2, 3, . . . K of diamonds, 27-39 represent A, 2, 3, . . . K of hearts, and 40-52 represent A, 2, 3, . . . K of spades. Of course, other numbering schemes can be used as well. Then to map a card to a different suit (such as scheme 3 in Table IV discussed below), the number 13 can be added to a card value. If the final value is greater than 52, than the final value can be subtracted by 52.

As can be seen by FIG. 2, now the player has a plurality of hands with different suits, which give the player a greater chance to hit suit-specific payouts.

After the suit transformations as illustrated in FIG. 2, the game can then proceed to a final stage which replaces non held cards in order to create final hands.

Figure 3:
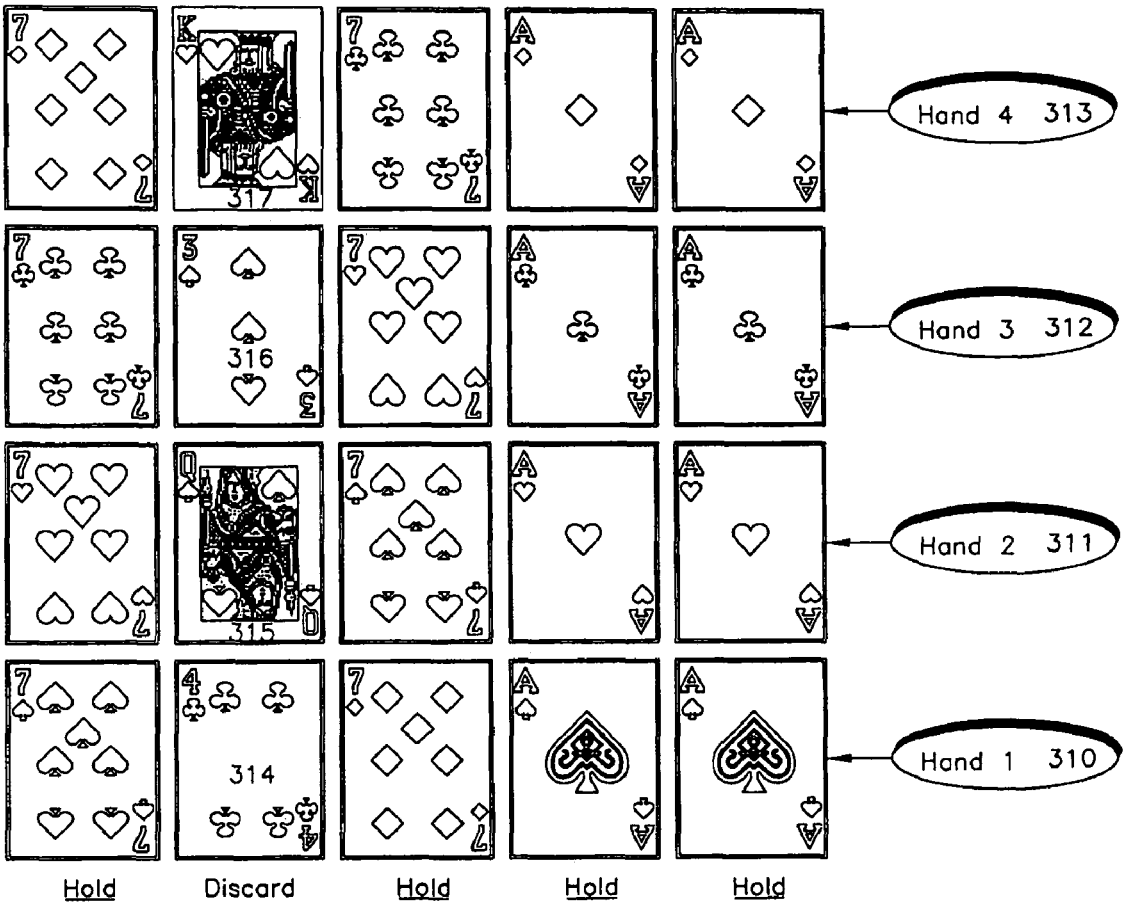
FIG. 3 is an exemplary output of a final stage, according to an embodiment.

FIG. 3 is an exemplary output of a final stage, according to an embodiment.

A hand one 310 replacement card 314 is dealt to replace the discarded card 207 in hand one 310 from FIG. 2. A hand two 311 replacement card 315 is dealt to replace the discard card 207 in hand two 311. A hand three 312 replacement card 316 is dealt to replace the discard card 207 in hand three 312. A hand four 313 replacement card 317 is dealt to replace the discard card 207 in hand four 313.

Note of course that any combination of held cards and discarded cards can be used and the held cards/discarded cards selected here are merely one example. For every discarded card, cards are not transformed but instead replaced (on the draw) by dealing new cards for each respective location in each hand. Further, any number of hands can be played simultaneously.

In a further embodiment, different rows can have different payouts associated with them. For example, hand one 310 can have a first paytable, hand two 311 can have a second (higher) paytable, etc. A higher paytable can be a paytable with one or more payouts which are higher. Alternatively, hand four 313 can have a first paytable, and hand three 312 can have a higher paytable, etc. Alternatively, different rows can have different paytables wherein some hands can pay higher and some can pay lower. A progressive jackpot may be available only on a particular hand or an all hands.

After new cards are dealt, the (best) rank of each hand can be computed, and awards can be generated based on a paytable.

The method then proceeds to operation 408, which computes the best ranks of each hand. This can be done as known in the art.

The method then proceeds to operation 410, which generates awards. If any of the hands are winning ranks, then a respective payout is made based on a paytable.

Figure 5:
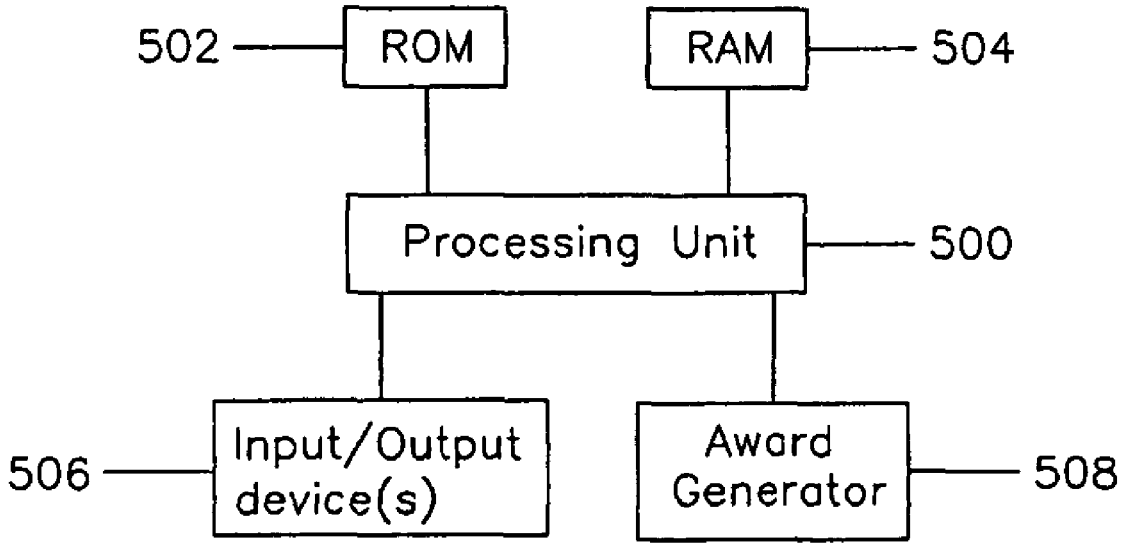
FIG. 5 is an exemplary block diagram illustrating hardware used to implement an embodiment.

FIG. 5 is an exemplary block diagram illustrating hardware used to implement an embodiment.

A processing unit 500 is connected to a ROM 502, RAM 504, input/output devices 506. The processing unit 500 is also connected to an award generator 508 which can dispense cash or credits to players on winning hands. Not pictures is a computer readable storage medium, such as a CD-ROM, which can store programs for performing the methods described herein.

Note that the game can be played with each card being dealt from a separate deck (e.g. if two hands are played, then 10 decks are used, one for each card). Alternatively, each row can be dealt from a separate deck for that row. In the latter version, when cards are transformed, the transformed card can then be removed from that row's respective remaining deck to be used for replacement cards.

Table I below is an example of a paytable comprising winning ranks and respective payouts for a plurality of credits wagered. For example, if a player attains a straight flush with 2 credits bet, the player wins 300 credits. Note that Table I is for an embodiment in which each card is dealt from a separate deck.

TABLE I

| | Credits | 1 | 2 | 3 | 4 | 5 | ... | 37 | 38 | 39 | 40 |
|---|---|---|---|---|---|---|---|---|---|---|---|
| Five Aces | Spades | 10,000 | 20,000 | 30,000 | 40,000 | 50,000 | | 64,000 | 64,000 | 64,000 | 64,000 |
| Five of a Kind | Same Suit | 500 | 1,000 | 1,500 | 2,000 | 2,500 | | 18,500 | 19,000 | 19,500 | 20,000 |
| Royal Flush | | 500 | 1,000 | 1,500 | 2,000 | 2,500 | | 18,500 | 19,000 | 19,500 | 20,000 |
| Five of a Kind | | 150 | 300 | 450 | 600 | 750 | | 5,550 | 5,700 | 5,850 | 6,000 |
| Straight Flush | | 150 | 300 | 450 | 600 | 750 | | 5,550 | 5,700 | 5,850 | 6,000 |
| Four of a Kind | Same Suit | 75 | 150 | 225 | 300 | 375 | | 2,775 | 2,850 | 2,925 | 3,000 |
| Four of a Kind | | 20 | 40 | 60 | 80 | 100 | | 740 | 760 | 780 | 800 |
| Full House | Same Suit | 15 | 30 | 45 | 60 | 75 | | 555 | 570 | 585 | 600 |
| Full House | | 7 | 14 | 21 | 28 | 35 | | 259 | 266 | 273 | 280 |
| Flush | | 5 | 10 | 15 | 20 | 25 | | 185 | 190 | 195 | 200 |
| Straight | | 5 | 10 | 15 | 20 | 25 | | 185 | 190 | 195 | 200 |
| Three of a Kind | Same Suit | 3 | 6 | 9 | 12 | 15 | | 111 | 114 | 117 | 120 |
| 2 Pair | Same Suit | 3 | 6 | 9 | 12 | 15 | | 111 | 114 | 117 | 120 |
| Three of a Kind | | 1 | 2 | 3 | 4 | 5 | | 37 | 38 | 39 | 40 |
| 2 Pair | | 1 | 2 | 3 | 4 | 5 | | 37 | 38 | 39 | 40 |

Note that in FIGS. 1, 2, and 3, each card is dealt from a separate deck. This is evident in that there are two Aces of spades in hand one. In an alternative embodiment, each hand can be dealt from its own separate deck. For example, hand one is dealt from a first deck, hand two is dealt from a second deck, etc.

Figure 4:
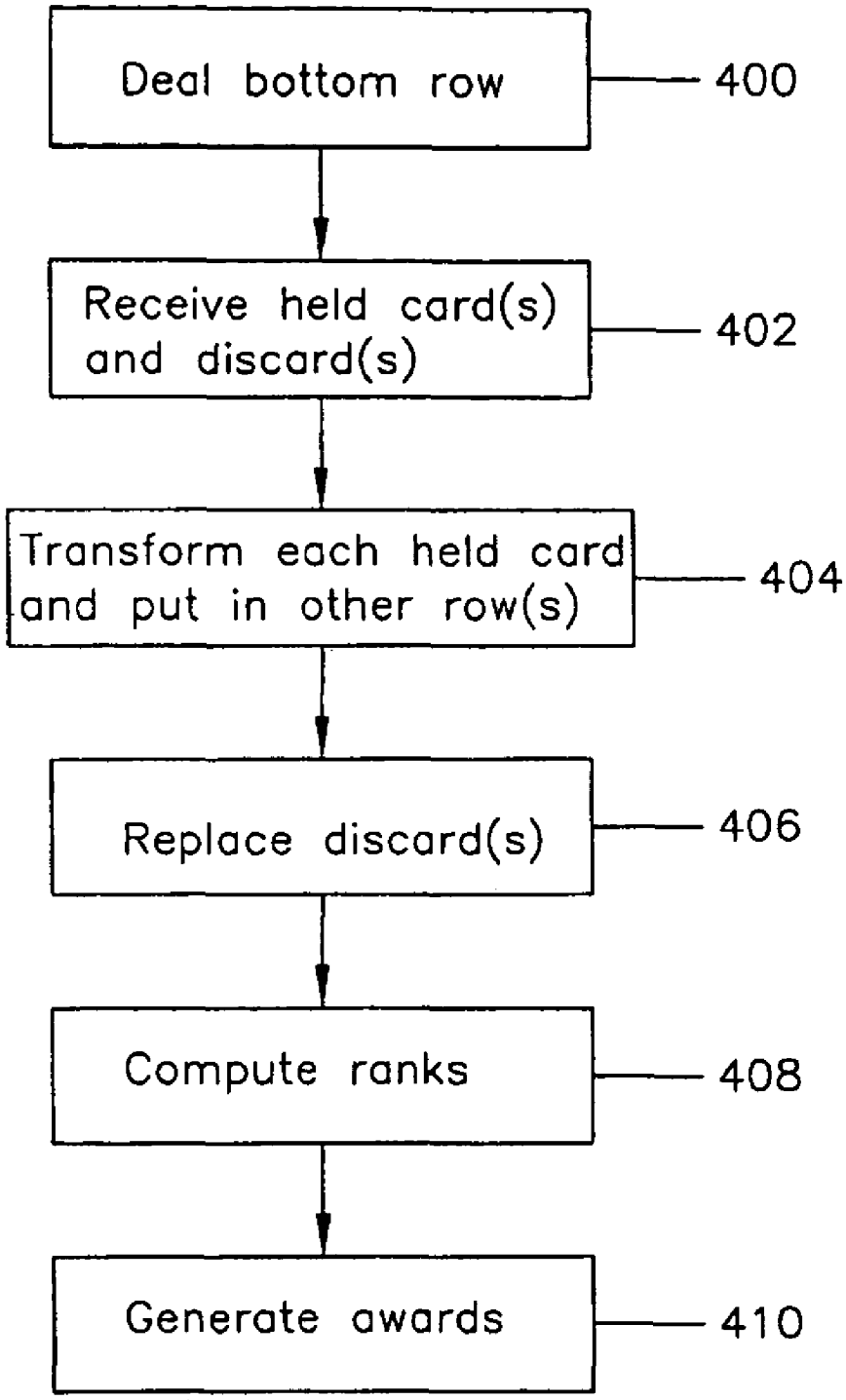
FIG. 4 is an exemplary flowchart illustrating a method of implementing an embodiment.

FIG. 4 is an exemplary flowchart illustrating a method of implementing an embodiment.

The method starts with operation 400, which deals a bottom row. The cards can be displayed on an output device such as a CRT.

The method proceeds to operation 402, which receives held card(s) and discard(s) selections from the player. This can be accomplished as known in the art, such as using a touch screen, mouse, buttons, etc.

The method then proceeds to operation 404, which transforms each held card and puts the transformed card in other rows. This can be accomplished as described herein.

The method then proceeds to operation 406, which replaces the discard(s) for all rows.

Any of the winning ranks can have a progressive jackpot associated with them. For example, five aces of spades can pay a progressive, while five aces of other suits can pay a fixed jackpot.

Table II is another example of winning ranks, according to an embodiment.

TABLE II

| |
|---|
| 5 A's Spades |
| 5 of a kind (same suits) |
| 5 of a kind (mixed suits) |
| Royal Flush |
| Straight Flush |
| 4 of a kind (same suits) |
| 4 of a kind (mixed suits) |
| Full House (same suits) |
| Full House (mixed suits) |
| Flush |
| Straight |
| 3 of a kind (same suits) |

TABLE II-continued

| |
|---|
| 3 of a kind (mixed suits) |
| 2 Pair (same suits) |
| 2 Pair (mixed suits) |

Table III below illustrates another example of a set of winning ranks.

TABLE III

| |
|---|
| Diamond Royal Flush |
| Royal Flush (not Diamond) |
| Diamond Straight Flush |
| Straight Flush (not Diamond) |
| Four of a kind |
| Full House |
| Diamond Flush |
| Flush (not Diamond) |
| Straight |
| Three of a Kind |
| Two Pair |
| Jacks or Better |

Note in the example in Table III, some or all hands of a particular suit (in this case diamonds) are separate ranks and can pay higher than their counterpart winning ranks. For example, a diamond royal flush can pay more than a royal flush of any other suit. Alternatively, each or some suits can pay higher than others, for example a spades hand (a hand of all spades) can pay the most, then a hearts hand is the next highest, then a clubs hand is the next highest, then a diamonds hand pays the least. In this manner. By transforming suits as described herein, a player can have multiple tries to hit a higher paying winning rank. Thus, transforming suits combined with winning payouts such as that in Table III (where winning hands of certain suits can pay more or less), can result in a multi line game with a reduced variance over a standard multi line poker game. This can be desirable to some multi line poker players, since players are already betting on multiple hands simultaneously and can lose money very quickly. Thus, according to the methods described herein, a player's money can last longer (on average) than a standard multi-line game.

Table IV below illustrates nine different ways to map suits.

TABLE IV

| Original | 1 | 2 | 3 | 4 | 5 | 6 | 7 | 8 | 9 |
|---|---|---|---|---|---|---|---|---|---|
| C | D | D | D | H | H | H | S | S | S |
| D | C | S | H | C | S | S | H | H | C |
| H | S | C | S | S | D | C | D | C | D |
| S | H | H | C | D | C | D | C | D | H |

The first column in Table IV represents original suits. The other 9 columns represent different possible transformations. For example, using the first transformation (column 1), clubs are mapped to diamonds, diamonds are mapped to clubs, hearts are mapped to spades, and spades are mapped to hearts. Thus, the mappings in Table IV allow up to ten simultaneous hands (the base hand at the bottom plus nine transformed hands). Note that in Table IV, suits are not mapped to the same suit, although in a less preferred embodiment this can be done as well (e.g. 256 possible mappings can be done if you allow mappings to the same suit).

In the examples illustrated in FIGS. 2 and 3, hand 2 202 uses mapping #2, hand 3 204 uses either mapping #3 or mapping #7, and hand 4 206 uses mapping #4.

Tables V, VI, and VII below illustrate examples of different exemplary paytables, according to embodiments of the present general inventive concept. For these paytables, each card is dealt from a different deck (e.g. for four rows, twenty decks are used). The top row uses mapping scheme #2 from Table IV, the second row uses mapping scheme #7, and the third row uses mapping scheme #6. Note that the return on the bottom hand is different from the other hand because, when a card is discarded on the bottom hand, that particular deck no longer has the card; in the other hands, the corresponding deck still has that card in its deck. The game can also be programmed wherein a card discarded in the bottom hand is also not present in the non-bottom respective decks, thereby equalizing the returns.

TABLE V

| Hand | Pay | Probability | Return |
|---|---|---|---|
| | bottom hand | | |
| AAAAA spades | 10000 | 0.000005% | 0.0532% |
| 5 of a kind suited | 500 | 0.0003% | 0.1351% |
| Royal Flush | 500 | 0.0014% | 0.6970% |
| 5 of a kind | 75 | 0.0691% | 5.1828% |
| Straight Flush | 150 | 0.0116% | 1.7341% |
| 4 of a Kind suited | 75 | 0.0252% | 1.8895% |
| 4 of a Kind | 12 | 1.5987% | 19.1844% |
| Full House suited | 9 | 0.0423% | 0.3810% |
| Full House | 6 | 2.7844% | 16.7063% |
| Flush | 4 | 2.8621% | 11.4483% |
| Straight | 4 | 1.1833% | 4.7331% |
| 3 of a kind suited | 3 | 0.6848% | 2.0545% |
| 2 Pairs suited | 3 | 0.7992% | 2.3976% |
| 3 of a kind | 1 | 11.8437% | 11.8437% |
| 2 Pairs | 1 | 14.5463% | 14.5463% |
| | | total | 92.9870% |
| | 2nd-4th Hands | | |
| AAAAA spades | 10000 | 0.000005% | 0.0513% |
| 5 of a kind suited | 500 | 0.0003% | 0.1302% |
| Royal Flush | 500 | 0.0014% | 0.6772% |
| 5 of a kind | 75 | 0.0665% | 4.9887% |
| Straight Flush | 150 | 0.0112% | 1.6859% |
| 4 of a Kind suited | 75 | 0.0246% | 1.8448% |
| 4 of a Kind | 12 | 1.5597% | 18.7169% |
| Full House suited | 9 | 0.0419% | 0.3768% |
| Full House | 6 | 2.7529% | 16.5176% |
| Flush | 4 | 2.7917% | 11.1669% |
| Straight | 4 | 1.1690% | 4.6759% |
| 3 of a kind suited | 3 | 0.6785% | 2.0356% |
| 2 Pairs suited | 3 | 0.8029% | 2.4088% |
| 3 of a kind | 1 | 11.7089% | 11.7089% |
| 2 Pairs | 1 | 14.5652% | 14.5652% |
| | | total | 91.5507% |
| | Payout | 4 lines | 91.9098% |
| | | 3 lines | 92.0295% |
| | | 2 lines | 92.2689% |

TABLE VI

| Hand | Pay | Probability | Return |
|---|---|---|---|
| | bottom hand | | |
| AAAAA spades | 10000 | 0.000005% | 0.0532% |
| 5 of a kind suited | 500 | 0.0003% | 0.1351% |
| Royal Flush | 500 | 0.0014% | 0.6970% |
| 5 of a kind | 75 | 0.0691% | 5.1828% |
| Straight Flush | 150 | 0.0116% | 1.7341% |
| 4 of a Kind suited | 100 | 0.0252% | 2.5193% |
| 4 of a Kind | 12 | 1.5987% | 19.1844% |
| Full House suited | 9 | 0.0423% | 0.3810% |
| Full House | 6 | 2.7844% | 16.7063% |

TABLE VI-continued

| Hand | Pay | Probability | Return |
|---|---|---|---|
| Flush | 4 | 2.8621% | 11.4483% |
| Straight | 5 | 1.1833% | 5.9163% |
| 3 of a kind suited | 3 | 0.6848% | 2.0545% |
| 2 Pairs suited | 3 | 0.7992% | 2.3976% |
| 3 of a kind | 1 | 11.8437% | 11.8437% |
| 2 Pairs | 1 | 14.5463% | 14.5463% |
| | | total | 94.8001% |
| | 2nd-4th Hands | | |
| AAAAA spades | 10000 | 0.000005% | 0.0513% |
| 5 of a kind suited | 500 | 0.0003% | 0.1302% |
| Royal Flush | 500 | 0.0014% | 0.6772% |
| 5 of a kind | 75 | 0.0665% | 4.9887% |
| Straight Flush | 150 | 0.0112% | 1.6859% |
| 4 of a Kind suited | 100 | 0.0246% | 2.4598% |
| 4 of a Kind | 12 | 1.5597% | 18.7169% |
| Full House suited | 9 | 0.0419% | 0.3768% |
| Full House | 6 | 2.7529% | 16.5176% |
| Flush | 4 | 2.7917% | 11.1669% |
| Straight | 5 | 1.1690% | 5.8449% |
| 3 of a kind suited | 3 | 0.6785% | 2.0356% |
| 2 Pairs suited | 3 | 0.8029% | 2.4088% |
| 3 of a kind | 1 | 11.7089% | 11.7089% |
| 2 Pairs | 1 | 14.5652% | 14.5652% |
| | | total | 93.3347% |
| | Payout | 4 lines | 93.7010% |
| | | 3 lines | 93.8231% |
| | | 2 lines | 94.0674% |

TABLE VII

| Hand | Pay | Probability | Return |
|---|---|---|---|
| | bottom hand | | |
| AAAAA spades | 10000 | ###### | 0.0532% |
| 5 of a kind suited | 500 | 0.0003% | 0.1351% |
| Royal Flush | 500 | 0.0014% | 0.6970% |
| 5 of a kind | 100 | 0.0691% | 6.9104% |
| Straight Flush | 150 | 0.0116% | 1.7341% |
| 4 of a Kind suited | 110 | 0.0252% | 2.7712% |
| 4 of a Kind | 12 | 1.5987% | 19.1844% |
| Full House suited | 10 | 0.0423% | 0.4233% |
| Full House | 6 | 2.7844% | 16.7063% |
| Flush | 4 | 2.8621% | 11.4483% |
| Straight | 5 | 1.1833% | 5.9163% |
| 3 of a kind suited | 3 | 0.6848% | 2.0545% |
| 2 Pairs suited | 3 | 0.7992% | 2.3976% |
| 3 of a kind | 1 | 11.8437% | 11.8437% |
| 2 Pairs | 1 | 14.5463% | 14.5463% |
| | | total | 96.8220% |
| | 2nd-4th Hands | | |
| AAAAA spades | 10000 | ###### | 0.0513% |
| 5 of a kind suited | 500 | 0.0003% | 0.1302% |
| Royal Flush | 500 | 0.0014% | 0.6772% |
| 5 of a kind | 100 | 0.0665% | 6.6516% |
| Straight Flush | 150 | 0.0112% | 1.6859% |
| 4 of a Kind suited | 110 | 0.0246% | 2.7057% |
| 4 of a Kind | 12 | 1.5597% | 18.7169% |
| Full House suited | 10 | 0.0419% | 0.4187% |
| Full House | 6 | 2.7529% | 16.5176% |
| Flush | 4 | 2.7917% | 11.1669% |
| Straight | 5 | 1.1690% | 5.8449% |
| 3 of a kind suited | 3 | 0.6785% | 2.0356% |
| 2 Pairs suited | 3 | 0.8029% | 2.4088% |
| 3 of a kind | 1 | 11.7089% | 11.7089% |
| 2 Pairs | 1 | 14.5652% | 14.5652% |
| | | total | 95.2854% |

TABLE VII-continued

| Hand | Pay | Probability | Return |
|---|---|---|---|
| | Payout | 4 lines | 95.6695% |
| | | 3 lines | 95.7976% |
| | | 2 lines | 96.0537% |

Transforming suits as described herein can be advantageous for numerous reasons. It can provide the player more opportunities to achieve a particular suited hand (e.g. five aces of spades). Thus, by providing the player different opportunities to make certain hands, this can reduce the variance of the game.

It is further noted that other types of transformations can be applied as well besides changing suits. For example, changing card values (e.g. adding one to every card, etc.) can be performed as well.

It is also noted that any type of gaming machine can implement the present invention, whether the gaming machine is video or mechanical, finite or random environment, class III or any other class, local software or downloadable client, or any other software/hardware implementations of gaming machines currently known in the art.

It is also noted that any and/or all of the above embodiments, configurations, variations of the present invention described above can mixed and matched and used in any combination with one another. Any operation described herein can be optional and operations can be performed in any sensible order. Any claim herein can be combined with any others (unless the results are nonsensical). Further, any mathematical formula given above also includes its mathematical equivalents, and also variations thereof such as multiplying any of the individual terms of a formula by a constant(s) or other variable.

Moreover, any description of a component or embodiment herein also includes hardware, software, and configurations which already exist in the prior art and may be necessary to the operation of such component(s) or embodiment(s). Further, instructions for performing any of the methods described herein can be stored on a computer readable storage, such as a CD-ROM, DVD, semiconductor memory, etc.

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. An electronic gaming device to implement a wagering game, the device comprising:

an output device;

a processing unit, configured to execute instructions on a processing unit to perform the following operations:

receiving a bet from a player;

dealing, using the output device, a first row of cards;

receiving an indication from the player, using an input device, of the hold card(s) and discard card(s) in the first row;

transforming, using the output device, each of the hold cards in two additional rows by copying a face value of each hold card in two additional rows and using different suits for the first row and the two additional rows for each hold card;

receiving, using the input device, an indication from the player to draw;

replacing, using the output device, the discard cards in the first row to form a first final hand;

dealing, using the output device, additional cards in the two additional rows to form additional final hands;

determining a first final hand rank for the first final hand and additional final hand ranks for the additional final hands; and paying a first award, if earned based on the first final hand rank and additional awards, if earned, based on the additional final hand ranks.

2. The device as recited in claim 1, wherein each card in the first row and each card in the additional rows are dealt from separate decks.

3. The device as recited in claim 1, wherein the first row is dealt from a first deck and each additional row is each dealt from an additional separate respective deck.

4. The device as recited in claim 1, wherein an award for a royal flush comprised of cards of a first suit is higher than an award for a royal flush comprised of cards of a suit different than the first suit.

5. The device as recited in claim 1, wherein an award for a hand comprised of all cards of an identical suit is higher than an award for a hand comprised of cards not all of an identical suit.

6. The device as recited in claim 1, wherein an award for a particular hand comprised of all cards of a particular suit pays a progressive jackpot.

7. The device as recited in claim 1, wherein the first final hand rank equals an additional final hand rank and the first award is different from a second award for the additional final hand rank.

8. The device as recited in claim 1, wherein if an award is a first value for a hand with all cards of a first suit and a second value for a hand with all cards of a second suit different from the first suit, the first value is not equal to the second value.

9. The device as recited in claim 1, wherein the first award is determined using a first paytable and an additional award in a different row is determined using a second paytable, the first paytable being different from the second paytable.

10. An electronic gaming device to implement a wagering game, the device comprising:

an output device;

a processing unit, configured to execute instructions on a processing unit to perform the following operations:

receiving a bet from a player;

dealing, using the output device, a first row of cards;

receiving, using an input device, an indication of hold cards and discard cards in the first row from the player;

transforming, using the output device, each of the hold card(s) into a second row of transformed cards by copying a face value of each hold card into the second row and transforming suits of each respective hold card copied in the second row using a first suit mapping;

transforming, using the output device, each of the hold card(s) into a third row of transformed cards by copying a face value of each hold card into the third row and transforming suits of each respective hold card copied in the third row using a second suit mapping, the second suit mapping different than the first suit mapping;

receiving, using the input device, an indication from the player to draw;

replacing, using the output device, the discard cards in the first row to form a first final hand;

dealing, using the output device, additional cards in the second row to form a second final hand, and dealing, using the output device, additional cards in the third row to form a third final hand;

determining, using the processing unit, a first final hand rank for the first final hand and a second final hand rank for the second final hand and a third final hand rank for the third final hand;

paying a first award, if earned, based on the first final hand rank, paying a second award, if earned, based on the second final hand rank, and paying a third award, if earned, based on the third final hand rank.

11. The device as recited in claim 10, wherein each card in the first, second, and third rows are dealt from separate decks.

12. The device as recited in claim 10, wherein cards in the first row are dealt from a first deck and cards in the second row are dealt from a second deck being different than the first deck, and cards in the third row are dealt from a third deck being different than the second deck.

13. The device as recited in claim 10, wherein an award for a royal flush comprised of cards of a first suit is higher than an award for a royal flush comprised of cards of a suit different than the first suit.

14. The device as recited in claim 10, wherein an award for a hand comprised of all cards of an identical suit is higher than an award for a hand comprised of cards not all of an identical suit.

15. The device as recited in claim 10, wherein an award for a particular hand comprised of all cards of a particular suit pays a progressive jackpot.

16. The device as recited in claim 10, wherein the first final hand rank equals the second final hand rank and the first award is different from the second award.

17. The device as recited in claim 10, wherein if an award is a first value for a hand with all cards of a first suit and a second value for a hand with all cards of a second suit different from the first suit, the first value is not equal to the second value.

18. The device as recited in claim 10, wherein the first award is determined using a first paytable and the second award is determined using a second paytable, the first paytable being different from the second paytable.

* * * * *